US009132570B2

(12) United States Patent
Trimborn

(10) Patent No.: US 9,132,570 B2
(45) Date of Patent: Sep. 15, 2015

(54) APPARATUS FOR APPLYING HOT MIX FOR TAR SEALED ROADS

(76) Inventor: Herbert Johann Trimborn, Queensland (AU)

( * ) Notice: Subject to any disclaimer, the term of this patent is extended or adjusted under 35 U.S.C. 154(b) by 7 days.

(21) Appl. No.: 13/978,080

(22) PCT Filed: Jan. 18, 2012

(86) PCT No.: PCT/AU2012/000034

§ 371 (c)(1),
(2), (4) Date: Jul. 2, 2013

(87) PCT Pub. No.: WO2012/100285

PCT Pub. Date: Aug. 2, 2012

(65) Prior Publication Data

US 2013/0294187 A1 Nov. 7, 2013

(30) Foreign Application Priority Data

Jan. 27, 2011 (AU) ..... 2011900243

(51) Int. Cl.

| | |
|---|---|
| ***B28C 5/46*** | (2006.01) |
| ***E01C 19/08*** | (2006.01) |
| ***E01C 19/10*** | (2006.01) |
| ***E01C 23/06*** | (2006.01) |

(52) U.S. Cl.

CPC ..... *B28C 5/466* (2013.01); *E01C 19/08* (2013.01); *E01C 19/104* (2013.01); *E01C 23/06* (2013.01)

(58) Field of Classification Search

CPC ..... E01C 19/1036; E01C 19/1063; E01C 19/1031; B28C 5/466

USPC ..... 366/23, 24, 25, 145, 147, 149, 144

See application file for complete search history.

(56) References Cited

U.S. PATENT DOCUMENTS

| | | | | |
|---|---|---|---|---|
| 1,546,185 | A * | 7/1925 | Andresen | 404/95 |
| 2,867,421 | A * | 1/1959 | Camm | 366/25 |
| 5,096,331 | A * | 3/1992 | Raymond | 404/118 |
| 6,109,826 | A * | 8/2000 | Mertes | 404/95 |
| 6,935,331 | B2 * | 8/2005 | Farmer | 126/343.5 A |

FOREIGN PATENT DOCUMENTS

| | | |
|---|---|---|
| AU | 2006297059 | 4/2007 |
| GB | 215264 | 5/1924 |
| NL | 8105313 | 6/1983 |

OTHER PUBLICATIONS

International Search Report, PCT/AU2012/000034, Jun. 4, 2012.

* cited by examiner

*Primary Examiner* — Tony G Soohoo
*Assistant Examiner* — Anshu Bhatia
(74) *Attorney, Agent, or Firm* — Young & Thompson

(57) ABSTRACT

An apparatus for preparing a hot mix including aggregate and bitumen includes a cylindrical vessel incorporating a mixing chamber having a rotating paddle assembly mixing aggregate and bitumen. A heating chamber is below the mixing chamber, separated by a dome shaped separating element, the center of which is above its periphery. The heating chamber's lower part has a diameter less than that of its upper part. A blower forces air into the lower part through a horizontal passage with a burner heating the air. The axis of the passage is offset from the vertical axis of the heating chamber. The heated air spirals upwardly and outwardly through the lower and upper parts of the heating chamber, traversing the separating element before exiting through apertures about the periphery of the separating element. The mix is heated by the heat transferred from the air as it passes over the separating element.

7 Claims, 2 Drawing Sheets

APPARATUS FOR APPLYING HOT MIX FOR TAR SEALED ROADS

This invention relates to an apparatus for applying hot mix for tar sealed roads.

BACKGROUND OF THE INVENTION

The present invention has been conceived in the course of development of an apparatus for applying hot mix, examples of which are described in the applicant's Australian patent application no. 2006297059 (hereinafter referred to as "the earlier application"). For the most part, the background to the present invention is set out in the specification of the earlier application and need not be repeated here.

In conventional practice, the surfaces of tar-sealed roads are covered by a layer of material comprising a mix of what is known as "aggregate" and bitumen. (When used in this specification, the term "mix" will refer to a mixture of these materials that is suitable for building and repairing roads, unless it is clear from the context that another meaning is intended). The aggregate comprises stone particles of various graded sizes. If the mixing has been properly carried out, the stones are randomly dispersed in a matrix of the bitumen and the bitumen should be bonded to each stone and should cover as much of the surface of the stone as possible. It is of course nearly impossible to achieve such an ideal mix in practice but it is at least a goal that is aimed at.

The apparatus disclosed in the earlier application comprises, inter alfa, an uprightly disposed, cylindrical vessel incorporating a mixing chamber arranged to receive aggregate and bitumen, heating means arranged to heat the aggregate and bitumen, and mixing means for mixing the aggregate and bitumen to form a hot mix. The heating means disclosed comprises a gas ring mounted in what is effectively a combustion chamber located below the mixing chamber. The vessel comprises a separating element which separates the combustion chamber from the mixing chamber, serving as both the floor of the mixing chamber and what will be called herein the "roof" of the combustion chamber. For reasons that are discussed in the earlier application, the separating element is advantageously dome shaped. The heating means comprises a gas ring positioned adjacent the periphery of the separating element so that the heat from the burning gas is spread evenly over the separating element.

In some jurisdictions, it has emerged that oil, particularly but not exclusively diesel oil, is preferred to gas as a fuel and it is an object of the present invention to provide an apparatus in which oil can be used for heating the hot mix. To achieve this object, the operational parameters of oil burners must be taken into account. In this regard, it is considered impossible, or at least economically and/or technically impractical, to provide oil burners arranged in a ring as a simple substitute for a gas ring for apparatus such as disclosed in the earlier application.

STATEMENTS OF THE INVENTION

In one aspect the invention, there is provided for preparing a hot mix comprising aggregate and bitumen, the apparatus comprising a vessel provided with a mixing chamber for containing aggregate and bitumen to be mixed, a heating chamber separated from the mixing chamber by a separating element that is heated by heating gas that passes through the heating chamber, and means to cause at least some of the heating gas to traverse the separating element in a substantially rotary path as the heating gas passes through the heating chamber.

In one aspect of the invention, the apparatus comprises means to cause at least some of the heating gas to traverse the separating element in a substantially rotary path that spirals outwardly as the heating gas passes through the heating chamber.

In one aspect of the invention, the apparatus comprises a passage through which the heating gas can be caused to flow into the heating chamber in such manner that the heating gas traverses the separating element in said substantially rotary path.

In one aspect of the invention, the separating element has a circular periphery and the passage is arranged to cause the heating gas to flow into the heating chamber at a position that is off set from the axis of the separating element.

In one aspect of the invention, the apparatus comprises a vessel provided with a mixing chamber for containing aggregate and bitumen to be mixed, and a heating chamber separated from the mixing chamber by a separating element that has a circular periphery and that is heated by heating gas that passes into the heating chamber through a passage having an axis that is off set from the axis of the separating element.

In one aspect of the invention, the heating chamber is cylindrical and has an axis that is coincident with the axis of the separating element.

In one aspect of the invention, the passage has a longitudinal axis that is disposed at a tangent to a circle centred on the axis of the heating chamber.

In one aspect of the invention, the vessel is uprightly disposed, the mixing chamber being located above the heating chamber and the separating element being located therebetween.

In one aspect of the invention, the separating element is dome shaped and has a peripheral portion and a centre portion that is located at a higher level than the peripheral portion.

In one aspect of the invention, the heating chamber has a floor comprised of an annular outer portion and a centre portion that is located at a lower level than the outer portion.

In one aspect of the invention, the passage opens into the heating chamber at a cylindrical face of the outer portion that is set in from the periphery of the outer portion.

In one aspect of the invention, the floor of the outer portion has a part that is located between and at a higher level than both the cylindrical face and the outer periphery of the outer portion.

In one aspect of the invention, the apparatus comprises an oil burner for producing the hot gas.

In an alternative aspect of the invention, the apparatus comprises a gas burner for producing the hot gas.

A floor that is shaped as defined above typically has what may be described as a gull wing shape in cross section.

BRIEF DESCRIPTION OF THE DRAWINGS

The invention is further discussed with reference to the accompanying drawings in which a vehicle for use in road repair is illustrated by way of example, and in which.

DETAILED DESCRIPTION OF THE INVENTION

Figure 1:
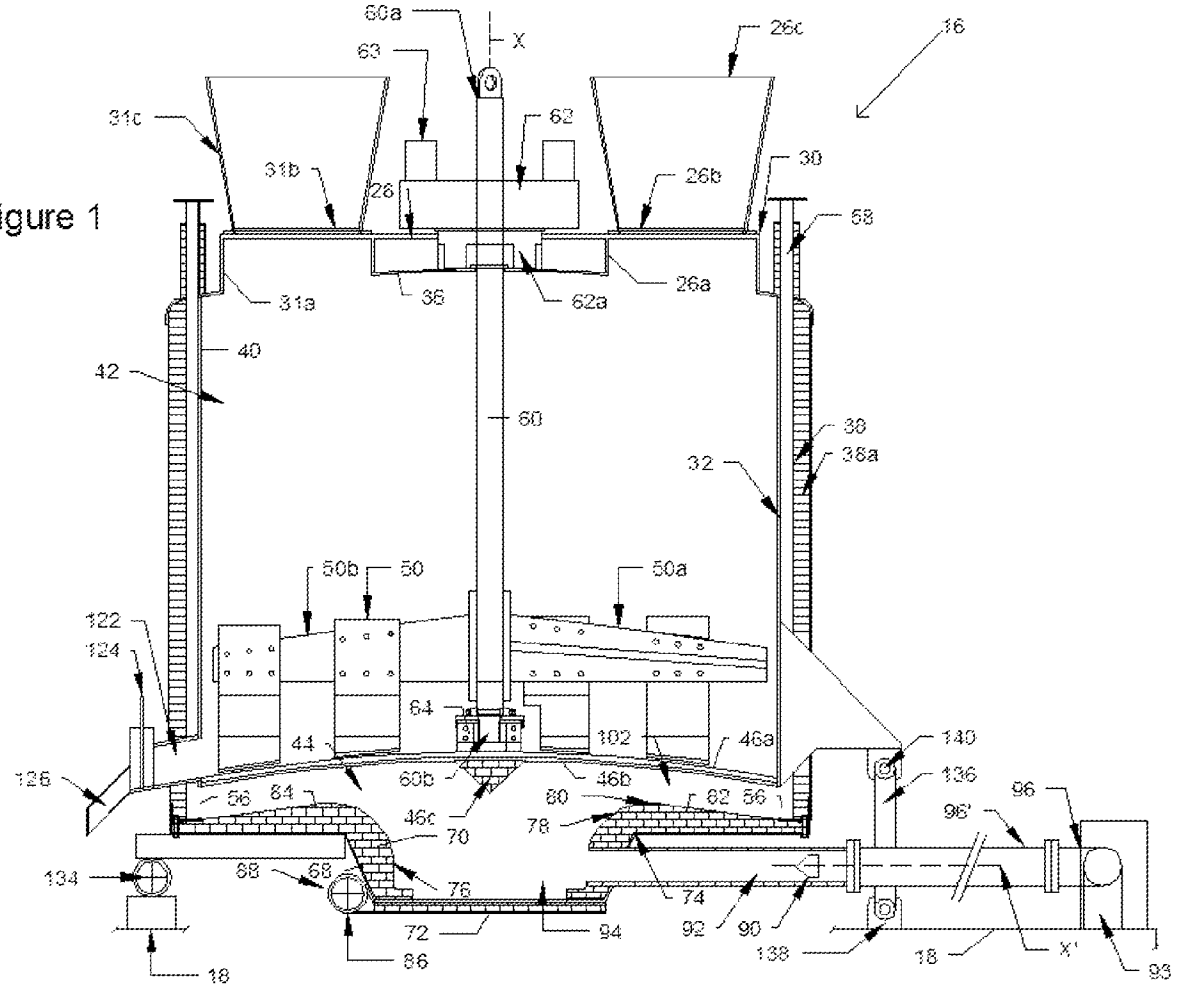
FIG. 1 is a somewhat schematic side elevation, partly in section, of a vessel for preparing a hot mix for carrying out road repairs.

The vessel 16 is designed to be ordinarily, but not essentially, mounted on a vehicle, such as a truck or trailer, by which it can be taken to a site at which road repairs are required. The vehicle, and the arrangements for mounting the vessel thereon, can be substantially similar to those disclosed in the specification of the aforementioned earlier application no. 2006297059 and are not described here in detail. In the description that follows, many parts of the vessel are not relevant to the present invention. Although they are substantially similar to the equivalent parts of the vessel shown in the earlier application, they are described here for ease of understanding. Furthermore, the design and construction of many parts of the vessel are either known or would present no difficulty to those skilled in the art. In some cases, these parts are commercially available. Parts that are not shown in the drawings fall into these categories unless it appears otherwise from the context.

The vessel 16 is mounted at the front of the frame (indicated schematically at 18) of the vehicle, which is provided with an engine that is coupled to a hydraulic pump assembly, neither of which is shown. The vessel 16 comprises an inner steel shell 32 with a right circular cylindrical body and, at its upper end, a dome shaped cross member that will be referred to as the top wall 36. A right circular cylindrical outer shell 38 surrounds the inner shell with a space therebetween forming an annular passage 40 between the two shells. The outer shell 38 is provided with an insulating lining 38*a*. The shell 32 incorporates two chambers including an upper chamber 42 that in use functions as a mixing chamber in which aggregate and bitumen are mixed together; and a lower chamber that in use functions as a heating chamber 44. The mixing chamber is separated the heating chamber by a separating element comprised of two dome shaped cross members 46*a*, 46*b* that are located one above the other and jointly act as the floor of the mixing chamber and the roof of the heating chamber. Mixing means in the form of a rotor comprising a paddle assembly 50 mounted on a shaft 60 is located in the mixing chamber. As will be described, hot gas is circulated through the heating chamber for heating the bitumen and aggregate mix in the mixing chamber. In the heating chamber, apertures 56 are formed in the wall of the shell 32. Via the annular passage 40, the apertures 56 connect the heating chamber 44 to stacks 58 spaced around the domed top 36 of the shell.

The aggregate is loaded into the mixing chamber through a downpipe 26*a* with a sliding cover 26*b* mounted on a baseplate 28 carried on a skirt 30 that is welded to the top wall 36 of the vessel. Similarly, the bitumen is loaded through a second downpipe 31*a* with a sliding cover 31*b*. The covers are of the guillotine type actuated by hydraulic rams (not shown). Chutes 26*c*, 31*c* may be bolted on the respective covers 26*b*, 31*b*. These chutes act as guides when the aggregate and bitumen are loaded by a front end loader or the like.

The paddle assembly 50 comprises a pair of mixing members in the form of paddle arms 50*a*, 50*b*. The paddle arms are mounted in alignment with each other on opposite sides of the shaft 60. The shaft 60 is of square cross section and is disposed longitudinally in the shell. The shaft is carried in bearing arrangements mounted on the floor of the mixing chamber and in the top wall 36 respectively and rotates about a rotational axis X that is coincident with the longitudinal axis of the shell that, in the present example, is nominally vertically disposed.

The upper end 60*a* of the shaft is housed in, and driven by, a gear box 62 carried on legs 62*a* mounted on the top wall 36 of the shell. The legs separate the gear box from the top wall in order to reduce the amount of heat that is transferred to the gear box from the mixing chamber. As described in the earlier application the gear box is coupled to hydraulic motors 63 that are connected by suitable hydraulic lines and controls to the pump assembly mentioned above. The gearbox 62 incorporates an upper bearing arrangement that rotatably supports the shaft 60 while enabling it to be rotated by the drive arrangement. At the same time the shaft is able to slide up and down in an axial direction in the aforementioned upper bearing arrangement as the apparatus heats up and cools down. This axial movement can be as much as 50 mm in the present example.

The lower-end 60*b* of the shaft is received in a lower bearing arrangement 64 mounted on the floor of the mixing chamber.

As noted, the separating element doubles as the floor 46*a* of the mixing chamber and the roof 46*b* of the heating chamber 44. Owing to its dome shape, the centre portion of the separating element is thus located at a higher level than the peripheral portion thereof.

The vessel comprises a lower cross member 68 lined with a liner 70 comprised of heat resistant, glass fibre-reinforced, refractory concrete having an upper surface that defines the floor of the heating chamber. The floor is comprised of a flat, horizontally disposed centre portion 72 surrounded by an outer portion 74. The centre portion is located at a lower level than the outer portion. The outer portion comprises what will be called a skirt 76 that forms an inner annular portion rising from the centre portion. In the present example, the skirt is vertical where it joins the centre portion. The upper surface 78 of the skirt is smoothly curved so that, at its outer periphery, it becomes horizontal as shown at 80. At this outer periphery, the skirt 76 joins what will be called an apron 82 that is an outer annular portion of the heating chamber floor. The upper surface 84 of the apron is disposed approximately parallel to the roof 46*b* of the heating chamber 44 and is so curved so that the surface 84 blends smoothly with the surface 78 of the skirt. At its outer periphery, the upper surface 84 is located at a lower level than at 80 where it joins the skirt.

The floor thus has what may be described as a gull wing or mushroom shape in cross section.

The flat centre portion 72 of the heating chamber floor is joined to the outer portion 74 by a hinge 86 provided with a simple spring arrangement 88 of any suitable design. In normal operation, the spring arrangement holds the centre portion 72 in place but enables the centre portion to spring open automatically in the event of an explosion occurring as a result of a build up of unburned fuel in the heating chamber.

A fuel burner 90 provides the hot gas for heating the mix of bitumen and aggregate. In the present example the burner 90 is a forced draught diesel oil burner but a suitable gas burner could equally be used The burner is located in a passage 92 through which air is blown by a fan assembly 93 and which conducts air heated by the burner into the zone 94 of the heating chamber that is surrounded by the skirt. The passage is comprised of an insulated pipe 96 of suitably heat resistant material. The pipe advantageously comprises a flexible portion 96' to enable the vessel to be tilted while leaving the fan assembly 93 in place. In its normal operating position, the passage is however disposed with its longitudinal axis X' tangential to a circle centred on the vertical axis X of the apparatus.

Burners of the type commonly used for central heating installations are suitable to be used as the burners for the apparatus exemplified herein. It is therefore not considered necessary to describe the burner 90 in detail. In the present example, the burner 90 is a model GL20/1 LN oil burner manufactured by Enertech GmbH of Germany. Alternatively, a gas burner, model no. GG20/1LN, manufactured by the same company, could be used It may be mentioned that burners that are designed to use both oil and gas are available. Although such burners could be used for the present apparatus, they are expensive.

The vessel 16 is mounted on the frame 18 of the vehicle (shown schematically) so as to be capable of tilting forward about a hinged connection 134 located at the front edge of the frame. The tilting is brought about by a hydraulic ram 136. The lower end of the ram is mounted on the frame through a pin seated between trunnions 138 welded to the frame. The upper end of the ram is similarly mounted on the vessel through a pin seated between trunnions 140 welded to the shell 32. The ram is actuated by the driver of the apparatus through suitable controls, not shown. As should be clear, the vessel remains stationary in the upright position on the frame while the aggregate and bitumen are being heated and mixed. The ram is able to lift the right hand side of the vessel (as viewed in FIG. 1) through a distance of about 400 mm.

Discharge means is provided in the form, in the present example, of a closable aperture or manhole 122 provided low down at the front of the shell, adjacent the floor of the mixing chamber. The manhole is closed by a manually operated, guillotine type gate 124. A chute 126 is mounted adjacent the manhole 122. When the aggregate and bitumen have been properly mixed and heated to the correct temperature in the mixing chamber, the mix can be discharged through the manhole and onto the chute. Discharging is effected by actuating the ram 136 to tilt the vessel forward so that, assisted by the rotating paddles, the hot mix can gravitate out of the manhole 122 which, when the vessel is in this position, is effectively located at the bottom of the mixing chamber.

Figure 2:
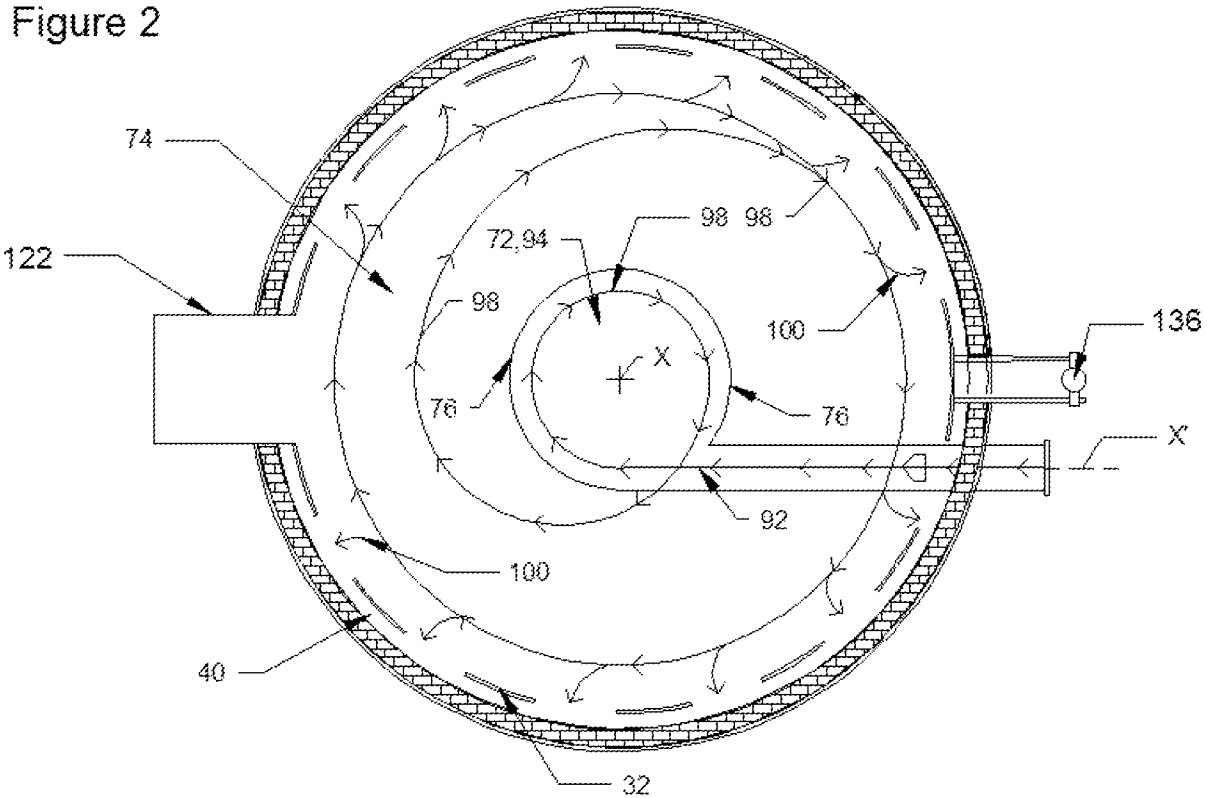
FIG. 2 is a diagrammatic plan view, also in cross section, of the vessel.

The design of the above described arrangement causes the hot gas that enters the heating chamber through the passage 92 to undergo a rotary motion that spirals outwardly from the line of entry which is coincident with the axis X' of the passage 92. The motion is indicated schematically in FIG. 2 by the arrow headed line 98, first passing into the zone 94 and then upwardly and outwardly as it enters the zone 102 located between the apron 82 and the outer periphery of the roof 46*b*. In the course of this motion, the separating element, and hence the mix of aggregate and bitumen therein, is heated. After traversing the zone 102, also with an outwardly spiralling rotary motion, the hot gas passes through the apertures 56 in the wall of the shell 32, as indicated by the arrows 100, and upwardly through the annular passage 40 before exiting to atmosphere through the stacks 58. Additional heat is transferred to the mix as the gas traverses the annular passage 40.

This motion of the hot gas, and in particular the rotary aspect thereof as it traverses the roof 46*b*, is beneficial in spreading heat evenly to the roof of the heating chamber and thence to the hot mix. Furthermore, although the heating arrangements shown herein are likely to be more costly than the arrangement shown in the earlier application, the present arrangement results in the heating chamber being heated faster and more efficiently than when a gas ring is used. In addition, the arrangements have the benefit that the burner can remain in operation while the vehicle is in motion. The flame of the gas ring burner shown in the earlier application is prone to being blown out by the draught caused by the motion.

It is not essential for the burner to be located in the position described. More than one burner could be provided and the passage could be omitted or more than one passage could be provided, each located in any suitable place as long as a rotary motion is imparted to the hot gas mixture as it traverses the separating element. Equally, one or more deflector plates could be mounted in the heating chamber which deflect the heated air that enters through the passage 92. For example, the heated air may be deflected towards the axial centre of the lower part of the heating chamber, while at the same time maintaining its rotary motion, before moving upwardly towards the centre of the roof 46*b*. This causes the heated air to traverse the separating element in an outwardly spiralling rotary motion, as previously described.

FIG. 1 also illustrates the optional provision of a capping plate 46*c* at the centre of the roof 46*b*. The plate 46*c* is in the shape of an inverted cone and prevents excessive heat from penetrating to the lower bearing arrangement 64. To this end the space between the plate 46*c* and the roof 46*b* may be filled with insulating material.

In the present example, the diameter of the roof 46*b* is 1800 mm and the radius of curvature thereof is 5000 mm. The distance between the centre portion 72 and the roof 46*b* (excluding the capping plate 46*c*) along the axis X is 440 mm. The diameter of the skirt 76 at its lower end is 600 mm and the radius of curvature of surface 78 is 200 mm The diameter of the surface 78 at the horizontal point 80 is 980 mm and the vertical distance between the surface 78 and the roof 46*b* at this point is 110 mm. The volume of the mixing chamber is 1215 liters and the mixing chamber is designed to hold a charge of 1000 liters (1 cubic meter) of aggregate and bitumen. The apparatus described and illustrates herein is capable of heating a cubic meter charge in 35-55 minutes, depending on the ambient temperature. Clearly, these dimensions, and the sizes and the shapes of the components in the illustrated example, are provided for illustrative purposes only and it is not intended that the scope of the invention should be limited thereto.

It should be clear that the principle differences between the vessels 16 shown herein and in the earlier application lie in the arrangements for heating the mix of bitumen and aggregate in the vessels 16. Apart from these differences, the constructional details of the vessel 16 disclosed herein, the manner of use thereof and the advantages to be obtained therefrom are similar to those disclosed in the earlier application and need not be discussed further herein.

The invention claimed is:

1. An apparatus for preparing a hot mix comprising aggregate and bitumen, the apparatus comprising a vessel that is mounted on a road vehicle and is provided with:

a mixing chamber for containing aggregate and bitumen to be mixed;

a heating chamber centered on an uprightly disposed axis;

a floor;

a separating element that is disposed above the floor and that separates the mixing chamber from the heating chamber; and a passageway through which heating gas enters the heating chamber;

wherein (a) the heating chamber has an outer periphery located below the mixing chamber;

(b) the floor comprises an upwardly facing annular surface that is centered on the axis of the heating chamber and extends inwardly from the outer periphery of the heating chamber towards the axis of the heating chamber, the upwardly facing annular surface defining an outer zone of the heating chamber through which the heating gas flows before leaving the heating chamber, the upwardly facing annular surface merging with an inwardly facing annular surface of the floor that is also centered on the axis of the heating chamber and that extends downwardly from the upwardly facing annular surface, the inwardly facing annular surface defining an inner zone of the heating chamber through which the heating gas passes before flowing into the outer zone; and (c) the passage has a longitudinal axis that is tangential to a circle centered on the axis of the heating chamber, the passage being configured to cause the heating gas that flows into the heating chamber from the passage to impinge angularly on the inwardly facing annular surface, to spiral upwardly and outwardly into the outer zone and to traverse the separating element in a substantially rotary path.

2. The apparatus according to claim 1, in which the separating element is dome shaped.

3. The apparatus according to claim 1, in which the upwardly facing annular surface merges with the inwardly facing surface at a position that is located at a higher level than the outer periphery of the heating chamber.

4. The apparatus according to claim 1, further comprising a forced draft oil burner for producing the heating gas.

5. The apparatus according to claim 1, in which the inwardly facing annular surface of the floor has a shape defined by refractory material with which the inwardly facing annular surface is lined.

6. The apparatus according to claim 5, in which the upwardly facing annular surface of the floor has a shape defined by refractory material with which the upwardly facing annular surface is lined.

7. The apparatus according to claim 1, including means for tilting the vessel so that hot mix in the mixing chamber gravitates towards an outlet located adjacent an outer periphery of the separating element.

* * * * *